US006637598B2

(12) United States Patent
Takai et al.

(10) Patent No.: US 6,637,598 B2
(45) Date of Patent: Oct. 28, 2003

(54) FOREIGN SUBSTANCE ELIMINATING APPARATUS

(75) Inventors: Yoshio Takai, Tochigi (JP); Shigeru Watanabe, Tochigi (JP); Hironori Watanabe, Tochigi (JP); Katsuhiko Kan, Tokyo (JP); Shinichi Kudo, Fukushima (JP)

(73) Assignee: Japan Tobacco Inc., Tokyo (JP)

( * ) Notice: Subject to any disclaimer, the term of this patent is extended or adjusted under 35 U.S.C. 154(b) by 21 days.

(21) Appl. No.: 10/085,764

(22) Filed: Mar. 1, 2002

(65) Prior Publication Data

US 2002/0130067 A1 Sep. 19, 2002

Related U.S. Application Data

(63) Continuation of application No. PCT/JP00/05866, filed on Aug. 30, 2000.

(30) Foreign Application Priority Data

Sep. 1, 1999 (JP) ..... 11-247782

(51) Int. Cl.[7] ..... B07C 5/02

(52) U.S. Cl. ..... 209/44.2; 209/639; 209/644; 209/665; 209/535; 209/536

(58) Field of Search ..... 209/44.2, 639, 209/644, 665, 535, 536

(56) References Cited

U.S. PATENT DOCUMENTS

| | | | | | |
|---|---|---|---|---|---|
| 3,384,233 | A | * | 5/1968 | Bolles | 209/631 |
| 3,799,338 | A | * | 3/1974 | Duda, Jr. | 209/635 |
| 5,339,962 | A | * | 8/1994 | Sommer et al. | 209/576 |
| 5,520,290 | A | * | 5/1996 | Kumar et al. | 209/580 |
| 6,260,712 | B1 | * | 7/2001 | Flottmann et al. | 209/639 |

FOREIGN PATENT DOCUMENTS

JP 7-113751 A 5/1995

* cited by examiner

*Primary Examiner*—Donald P. Walsh
*Assistant Examiner*—Jonathan R Miller
(74) *Attorney, Agent, or Firm*—Birch, Stewart, Kolasch & Birch, LLP

(57) ABSTRACT

A foreign substance eliminating apparatus transfers raw material by passing the raw material between an upstream conveyor (6) and a downstream conveyor (8), and detects a foreign substance on the upstream transfer conveyor with a foreign substance detector (9). An eliminating airflow (R) is ejected from a row of air nozzles (13) when the detected foreign substance falls down, and deflects the falling direction of the foreign substance. At this point, a small foreign substance ($B_S$) is blown off by the eliminating airflow, and sent to the foreign substancereceiving box (16). On the other hand, a large foreign substance ($B_L$) goes across the eliminating airflow, and falls down onto the bar screen conveyor (20). The bar screen conveyor captures the large foreign substance, and removes it outside of the conveyor.

5 Claims, 7 Drawing Sheets

FOREIGN SUBSTANCE ELIMINATING APPARATUS

This application is a Continuation of copending PCT International Application No. PCT/JP00/05866 filed on Aug. 30, 2000, which was not published in English and which designated the United States and on which priority is claimed under 35 U.S.C. §120, the entire contents of which are hereby incorporated by reference.

TECHNICAL FIELD

This invention relates to a foreign substance eliminating apparatus that has a function to capture, during the transfer process, foreign substances mixed into raw material, and a function to remove the foreign substances outside of the transfer path.

BACKGROUND ART

There might be various foreign substances already mixed into tobacco leaves, which are the raw materials of cigarette products, before they are supplied to a raw-material factory, for example. On account of this, a method by which all of the tobacco leaves are put through an air blow process to separate the foreign substances and the tobacco leaves using their difference in weight, was adopted as a conventional method to eliminate foreign substances from the tobacco leaves which are the raw material, in the raw-material processing stages of a raw-material factory of tobacco leaves.

However, there are various kinds of foreign substances mixed into the tobacco leaves that are the raw material, varying in their size, their shape, and their weight, and it is very difficult to separate all of the foreign substances from the tobacco leaves uniformly, with the above-mentioned air blow process.

DISCLOSURE OF THE INVENTION

An object of this invention is to provide a foreign substance eliminating apparatus that can effectively eliminate various kinds of foreign substances mixed into raw material.

The foreign substance eliminating apparatus of this invention is provided with: an upstream transfer path that transfers raw material; a downstream transfer path that receives and transfers raw materials falling down from being sent out of the terminus of the upstream transfer path; detecting means for detecting foreign substances from the raw materials being transferred on the upstream transfer path, and outputting a detection signal; deflecting means for deflecting the falling direction of the falling raw material and the foreign substance by ejecting an eliminating airflow towards the falling raw material, when it is determined that there exists a foreign substance within the raw material, based on the above-mentioned detection signal; capturing means for capturing the foreign substance passing through the aforementioned eliminating airflow and falling down, above the downstream transfer path; and eliminating means for removing the foreign substance captured by the capturing means, to the outside of the downstream transfer path.

With the above-mentioned foreign substance eliminating apparatus, the foreign substance and the falling raw material are blown off in the direction of the eliminating airflow, and eliminated instead of falling down onto the downstream transfer path, when a foreign substance is sent out from the terminus of the upstream transfer path. At this point, a relatively large foreign substance passes through the eliminating airflow, and continues to fall down towards the downstream transfer path, and is captured by the capturing means. The captured foreign substance is removed outside of the downstream transfer path by the eliminating means.

The capturing means includes a sieve-surface extending horizontally above the downstream transfer path, and covering the whole width of the downstream transfer path. It is preferred that the eliminating means is composed of a sieve conveyor having a sieve-surface, and that this sieve conveyor can move its sieve-surface in the traversing direction of the downstream transfer path. The foreign substance passing through the eliminating airflow and falling down onto the sieve conveyor is temporarily captured by the sieve-surface of the sieve conveyor. Then, the captured foreign substance is transferred in the traversing direction of the downstream transfer path by the movement of the sieve-surface, and removed outside of this path. On the other hand, the raw material that fell down with the foreign substance onto the sieve-surface, passes through the sieve-surface and drops down onto the downstream transfer path, and continues to be transferred.

The above-mentioned sieve conveyor includes a pair of endless cables, which is arranged on both sides of the sieve-surface and moved in synchronization with each other in the same direction, and also pluralities of rod-form-members that are bridged across the pair of endless cables and arranged in parallel with a prescribed interval, to constitute the sieve-surface. In this case, the sieve mesh is prescribed by the opening between the rod-form-members, and the sieve conveyor carries the rows of rod-form-members in one direction, by the movement of the endless cable.

The sieve conveyor can also have pluralities of sieve-surfaces in vertical layers, and when this is realized, undesired passing through of temporarily captured foreign substances through the sieve-surface is regulated plural times.

In this way, the foreign substance eliminating apparatus of this invention can eliminate various kinds of foreign substances, with high efficiency. And positive elimination of foreign substances, particularly those large foreign substances whose falling down direction is difficult to deflect sufficiently with only the eliminating airflow, contributes a great deal to the improvement in quality of products.

Moreover, when the sieve-surface of the sieve conveyor is constituted by an array of rod-form-members, it can sufficiently withstand the impact of the fall of the foreign substances, and when there are pluralities of sieve-surfaces, the capturing and elimination of the foreign substances can be done more positively.

BEST MODE FOR CARRYING OUT THE INVENTION

Figure 1:
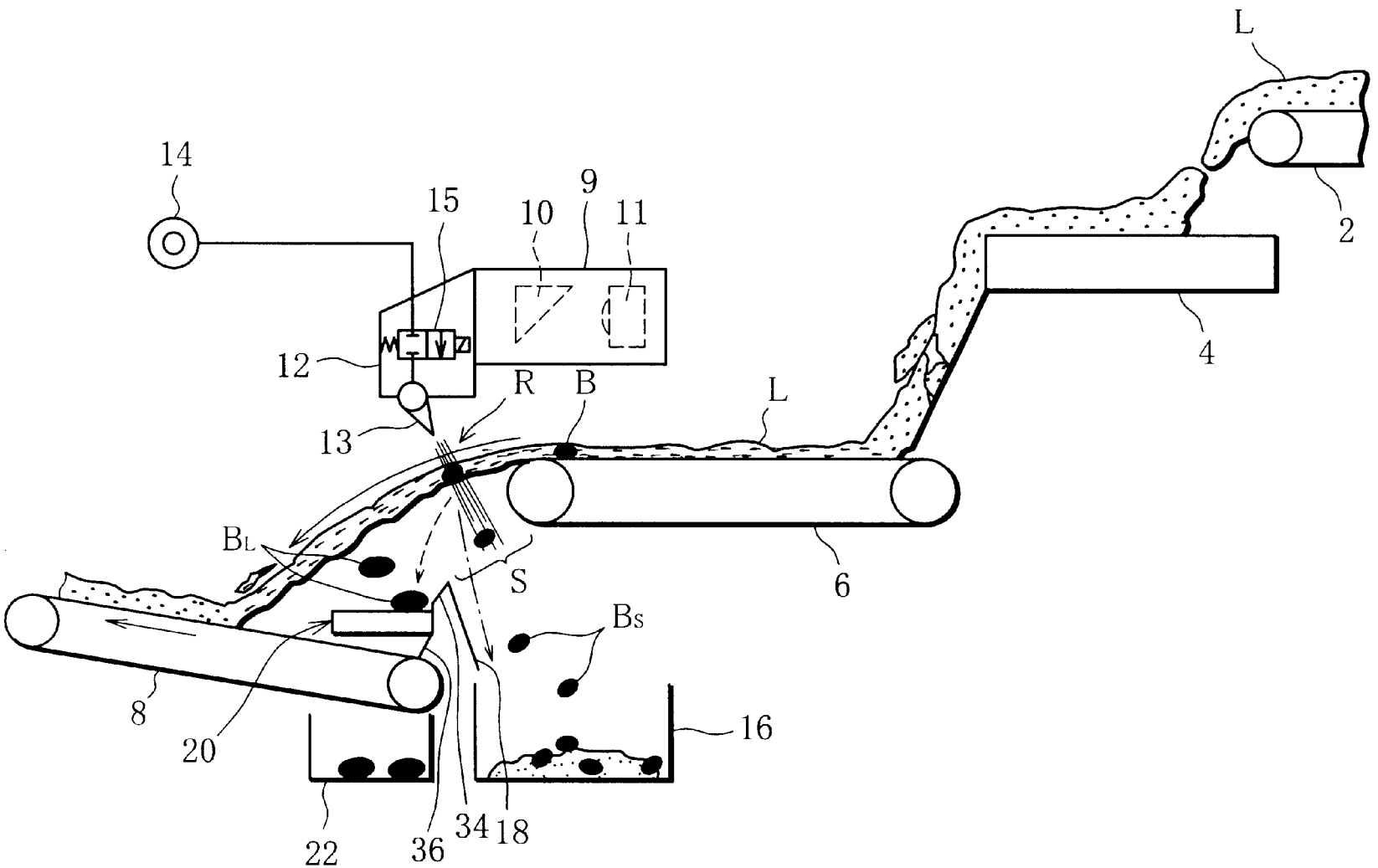
FIG. 1 is a schematic drawing showing the constitution of a foreign substance eliminating apparatus.

Referring to FIG. 1, a constitution of a foreign substance eliminating apparatus applied to a raw-material processing stage of a raw-material factory of cigarettes is shown in schematic form, as an example.

In the raw-material processing stage shown in FIG. 1, tobacco leaves L, which are the raw material, are first sent out from a transfer conveyor 2 towards an expansion conveyor, continuously. In an expansion conveyor 4 next thereto, the distribution of the tobacco leaves L is expanded to the full width of a main conveyor 6, and the tobacco leaves L are sent out towards the main conveyor 6 in that state. A downstream conveyor 8 is arranged down below the main conveyor 6, and also right in front of the main conveyor 6. The downstream conveyor 8 receives the tobacco leaves L sent out continuously from the terminus of the main conveyor 6, and transfers them towards the section conducting the next processing stage.

Since the upstream main conveyor 6 is run at a faster speed than the transfer speed of the transfer conveyor 2 and the expansion conveyor 4, the thickness of the fluidized bed of the tobacco leaves is made thinner on the main conveyor 6. On the other hand, the tobacco leaves L sent out from the terminus of the main conveyor 6 towards the downstream conveyor 8, falls in the direction of the solid-line arrow shown in FIG. 1 by inertia force, and jumps over the starting end area and reaches the mid section of the downstream conveyor 8.

A foreign substance detector 9 is installed above the main conveyor 6, and this foreign substance detector 9 has a built-in camera 11 that can image-pickup the transferring surface of the main conveyor 6 through a mirror image on the mirror 10. The foreign substance detector 9 makes data out of the image that was image-picked up by the embedded camera 11, and detects a foreign substance B from the difference in color tone between the tobacco leaf L and the foreign substance B, based on this image data. And the foreign substance detector 9 outputs a detection signal when it detects a foreign substance B.

An air ejection device 12 is integrally installed at the front end of the foreign substance detector 9, with respect to the transferring direction of the tobacco leaves L. This air ejection device 12 has plural air nozzles 13, and these air nozzles 13 can eject air towards an eliminating area S right in front of the terminus of the main conveyor 6. To be more specific, these air nozzles 13 are arranged in one row, or two or more rows, in the horizontal direction parallel to the terminus of the main conveyor 6, and the length of these rows are configured to be approximately the same value as the width of the main conveyor 6. The injection tip of the individual air nozzles 13 is pointed in the direction that intersects with the falling direction of the tobacco leaves L.

The air ejection device 12 receives high pressure air supply from a pneumatic source 14, and the air ejection device 12 is capable of ejecting the supplied high pressure air through each of the air nozzles 13 simultaneously. A supply passage for supplying high pressure air is provided at the air nozzle 13 of the air ejection device 12, and an open-close solenoid valve 15 is inserted into this supply passage. The air ejection device 12 is also provided with a controller (not shown) to control the action of this open-close solenoid valve 15. This controller has a function to open and close the open-close solenoid valve 15, based on the detection signal from the above-mentioned foreign substance detector 9.

When a detection signal is outputted from the foreign substance detector 9, the above-mentioned controller judges that there is a foreign substance B included in the tobacco leaves L falling down from being sent out of the terminus of the main conveyor 6, and the controller opens the open-close solenoid valve 15. When the open-close solenoid valve 15 is opened, the supply passage of high pressure air to the air nozzle 13 is opened, resulting in high pressure air ejecting through each of the air nozzles 13 simultaneously. The ejected high pressure air forms an eliminating airflow R within the eliminating area S. On account of this, the falling direction of the tobacco leaves L and the foreign substance B are deflected by this eliminating airflow R.

There is a foreign substance receiving box 16 placed and installed on a location right in front of the downstream conveyor 8, and also down below the main conveyor 6, and an eliminating chute 18 is installed above the downstream conveyor 8, and this eliminating chute 18 extends from the above-mentioned eliminating area S towards the foreign substance receiving box 16.

On the other hand, there is a bar screen conveyor 20 installed above the starting end area of the downstream conveyor 8, and this bar screen conveyor 20 extends from the eliminating area S towards the sending-out direction of the main conveyor 6. There are foreign substances receiving boxes 22 installed one each on both sides of the downstream conveyor 8.

Figure 2:
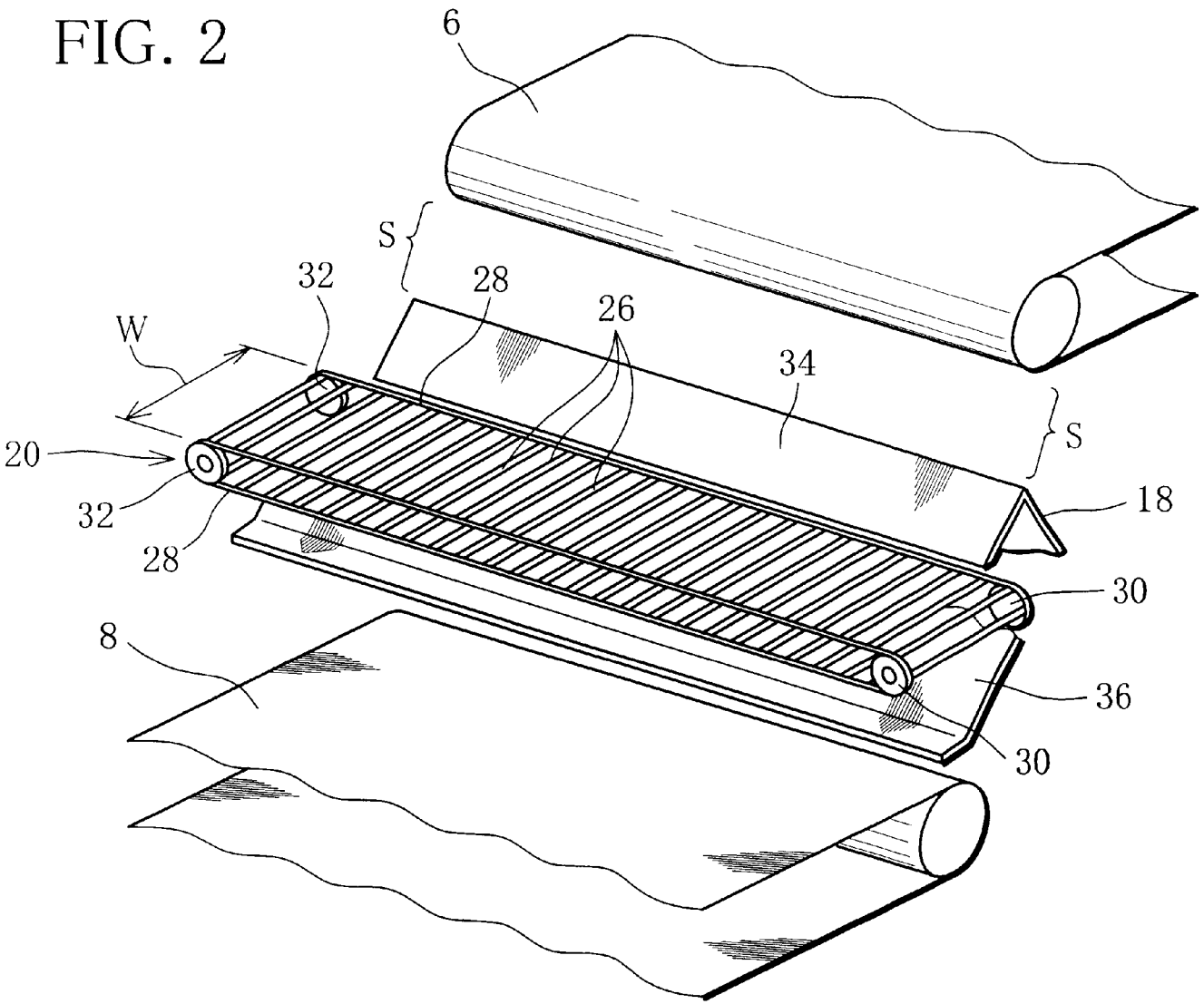
FIG. 2 is a perspective view specifically showing a bar screen conveyor.

Referring now to FIG. 2, the bar screen conveyor 20 is shown in detail. As shown in the drawing, the bar screen conveyor 20 has a plurality of rod-form-members 26 arranged in mutually parallel state, and these rows of rod-form-members 26 constitute a sieve-surface. This sieve-surface extends in the horizontal direction orthogonal to the downstream conveyor 8, which is the traversing direction of the downstream conveyor 8, and the sieve-surface has a length covering the whole width of the downstream conveyor 8 above the downstream conveyor 8.

The bar screen conveyor 20 has a pair of endless-traveling chains 28, and this pair of endless-traveling chains 28 are arranged one each on both sides of the sieve-surface, along its longitudinal direction. These traveling chains 28 are passed around a pair of sprockets 30 and 32, and these sprockets 30 and 32 are placed apart in the widthwise direction of the downstream conveyor 8. More details of the bar screen conveyor 20 will be described later.

A fall-off chute 34 is arranged and installed along the falling direction of the foreign substance B, between the bar screen conveyor 20 and the eliminating area S, and a base end of this fall-off chute 34 is connected to a base end of the above-mentioned eliminating chute 18. As shown in the drawing, a guide-chute 36 is arranged and installed between the bar screen conveyor 20 and the downstream conveyor 8, and this guide-chute 36 extends from one side edge of the bar screen conveyor 20 towards the starting end of the downstream conveyor 8.

Referring next to FIG. 3 to FIG. 6, the constitution of the bar screen conveyor 20 will be described in more detail. The bar screen conveyor 20 has a pair of side-frames 38, and these side-frames 38 extend on both sides of the sieve-surface in mutually parallel form, and also in the horizontal direction orthogonal to the transferring direction of the downstream conveyor 8.

Both end portions of the side-frame 38 are linked together to supporting legs 40 and 41, and these supporting legs 40 and 41 also constitute pairs on both sides of the sieve-surface. These supporting legs 40 and 41 compose a crank form in the vertical direction, and the interval between the lower vertical portions is wider than the interval between the upper vertical portions, viewed from between the pair of supporting legs 40 or 41. As a result, installing spaces allocated for the above-mentioned foreign substance receiving boxes 22 are secured between these supporting legs 40 and 41 (refer to FIG. 4). Incidentally, the individual supporting legs 40 and 41 have height-adjusting screws 42 at the bottom ends.

Figure 3:
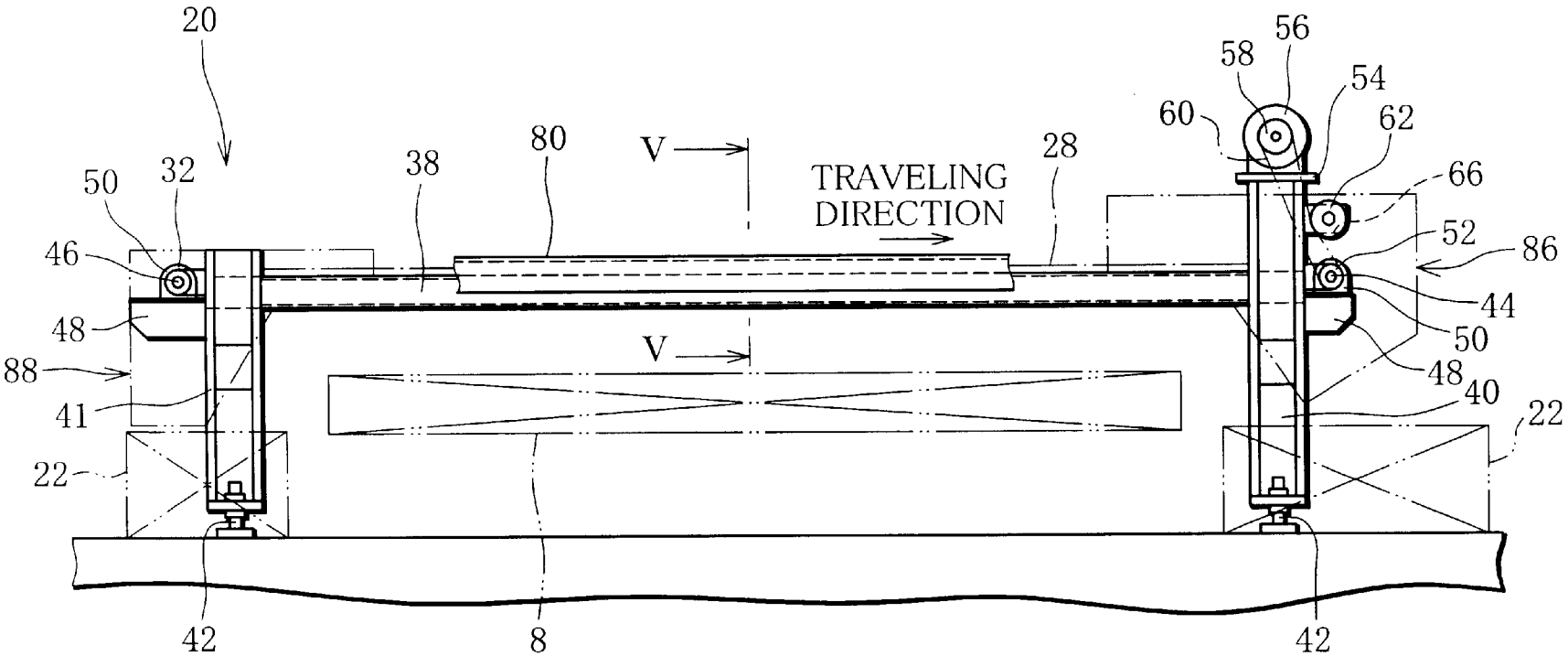
FIG. 3 is a front view of the bar screen conveyor.

The bar screen conveyor 20 has also a pair of sprocket axles 44 and 46, and these sprocket axles 44 and 46 are arranged near both ends of the side-frames 38, as shown in FIG. 3. And the above-mentioned sprockets 30 and 32 are mounted by fastening to each of the corresponding sprocket axles 44 and 46. A bearing 50 is also mounted on each of the supporting legs 40 and 41 through intervening brackets 48, and the sprocket axles 44 and 46 are supported so as to freely rotate by these intervening bearings 50.

In detail, one of the sprocket axles 46 pierces through both of the sprockets 32, and is supported on both ends by the above-mentioned bearings 50. On the other hand, the other sprocket axle 44 pierces through both of the sprockets 30. And one end portion of the sprocket axle 44 pierces and extends through the bearing 50, and a driving sprocket 52 is mounted by being fastened to the end portion (refer to FIG. 4).

Figure 4:
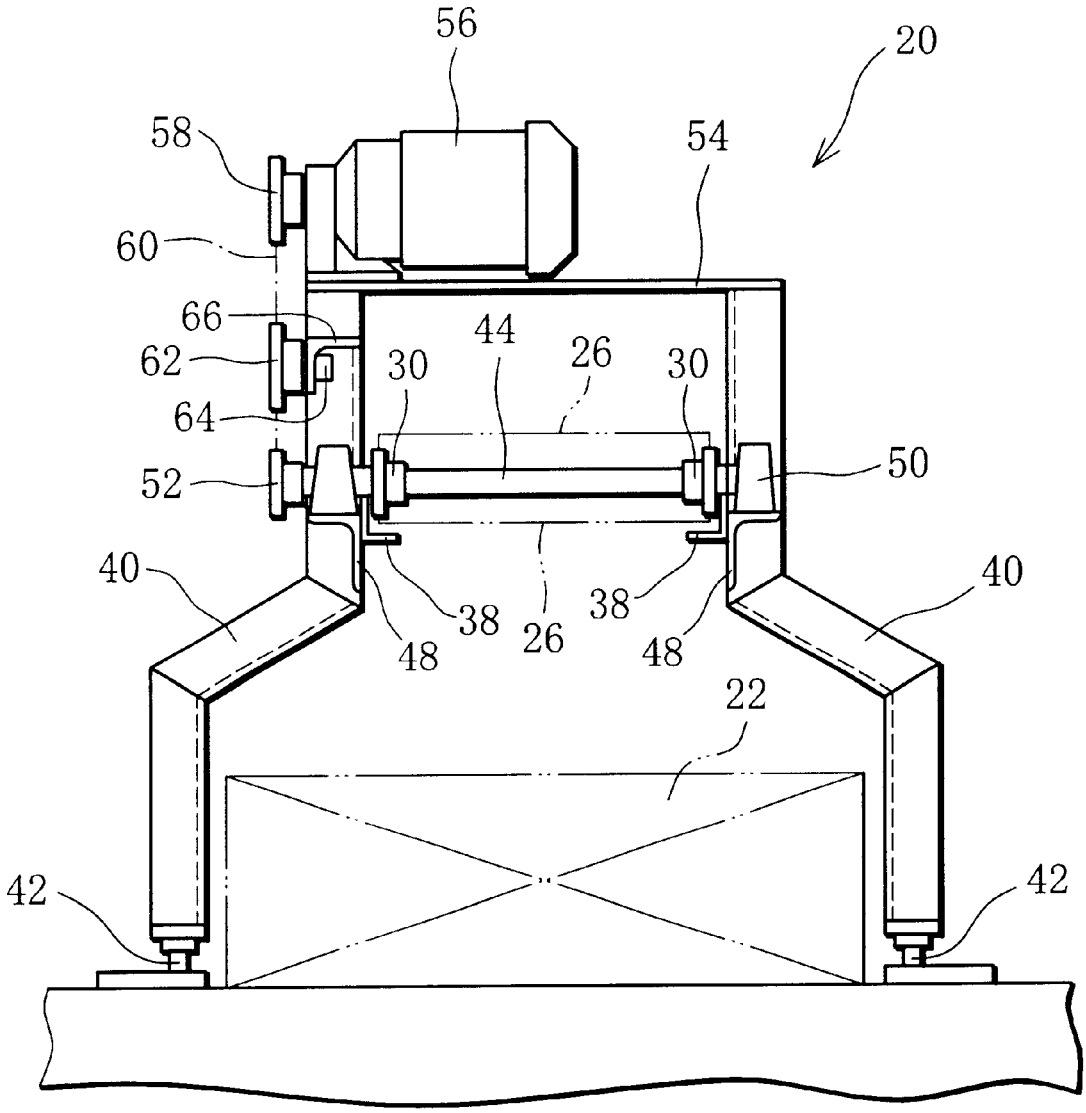
FIG. 4 is a right side view of the bar screen conveyor shown in FIG. 3.

As is apparent from FIG. 3, one of the pair of supporting legs 40 corresponding to the above-mentioned sprocket axle 44 has its upper end portions extended higher than the other of the pair of supporting legs 41, and these upper end portions are mutually linked together at the upper end of this extension, through an intervening cross-plate 54 (refer to FIG. 4).

The bar screen conveyor 20 also has an electric motor 56 for a driving source, and this electric motor 56 is mounted on top of the above-mentioned cross-plate 54. An output sprocket 58 is mounted on the output axle of the electric motor 56, and an endless driving chain 60 is passed around this output sprocket 58 and the driving sprocket 52.

A tightener-sprocket 62 is also arranged between the output sprocket 58 and the driving sprocket 52, within the same vertical plane as these sprockets, and this tightener-sprocket 62 is meshed to the outer circumference of the driving chain 60. This tightener-sprocket 62 has an idler axle 64 and their bearings (not shown) at its center, and this idler axle 64 is supported by the supporting legs 40 through an intervening bracket 66.

Figure 5:
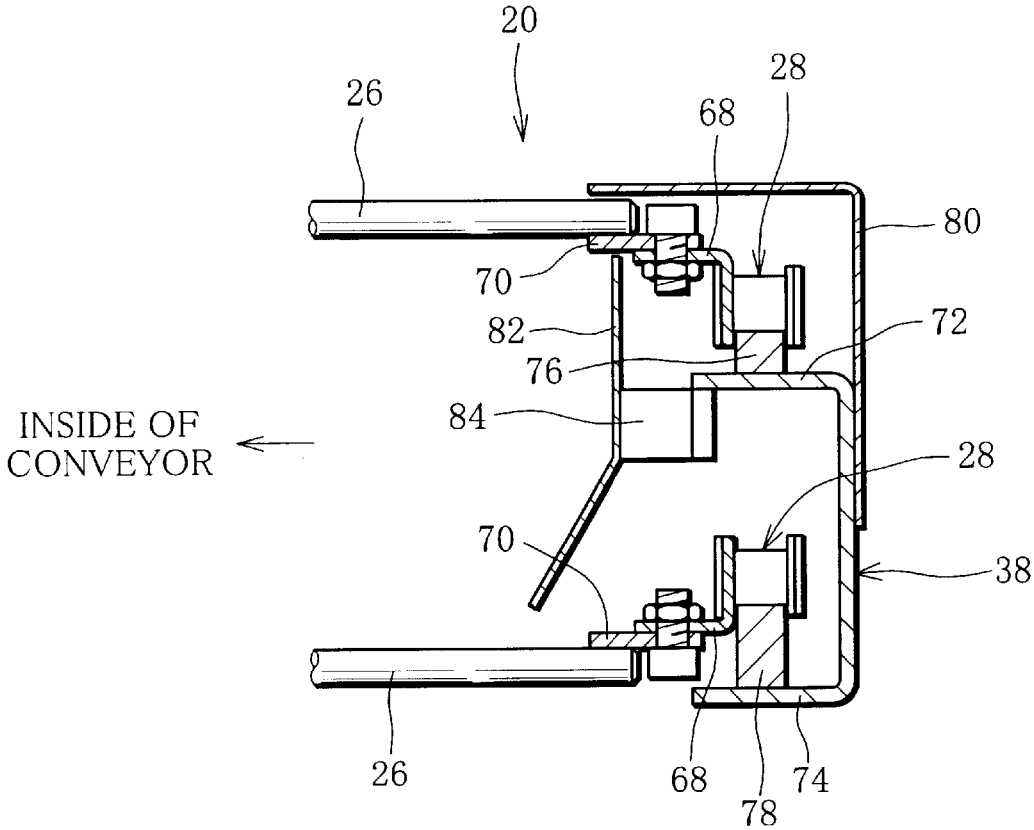
FIG. 5 is a sectional view taken along the V—V line in FIG. 3.
Figure 6:
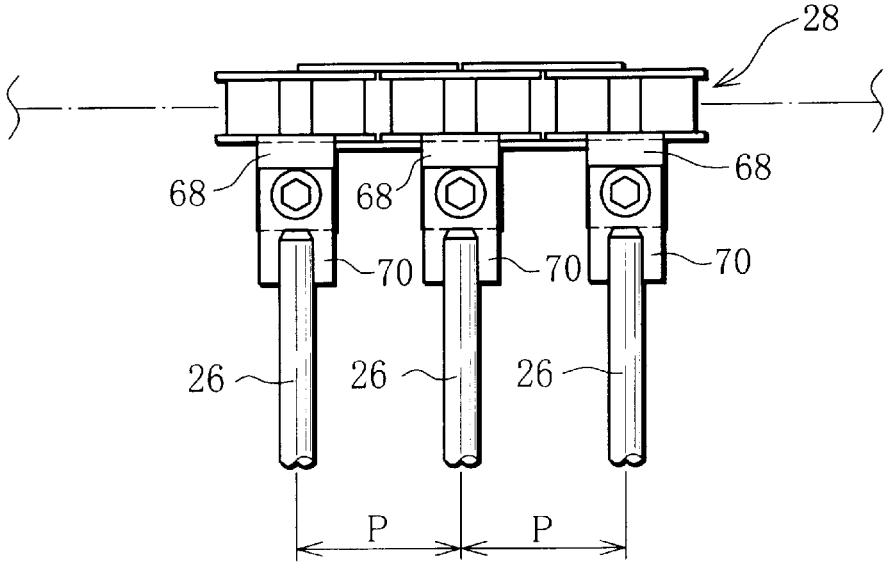
FIG. 6 is a drawing specifically showing the constitution of a traveling chain.

As shown in FIG. 5 and FIG. 6, the traveling chain 28 is composed of a roller chain with an attachment 68, and the individual attachments 68 are mounted on the whole circumference, with an interval of one chain link each. These attachments 68 on both of the traveling chains 28 are composed to be symmetrical, and the individual rod-form-members 26 are bridged across the corresponding attachments 68. To be more specific, the rod-form-members 26 are made of round bars for example, and brackets 70 are installed on both end portions of them. The rod-form-members 26 are tightened together to each of the corresponding attachments 68 with these brackets 70. The mounting pitch P of the bar-form-member 26 is configured to be approximately 30 mm, for example.

As is apparent from FIG. 5, the side-frame 38 has a channel-form section, and also has a vertical pair of horizontal flanges 72 and 74, with respect to the mounting posture shown in the drawing. When the traveling chain 28 is passed around the sprockets 30 and 32, and turned around, it passes above the flange 72 in the upper halfway circumference, and passes between the vertically positioned flanges 72 and 74 in the lower halfway circumference. These vertically positioned flanges 72 and 74 have rails 76 and 78 mounted on each of their top faces, and the traveling chain 28 is guided on top of these rails 76 and 78. These rails 76 and 78 extend on top of the whole length of the corresponding flanges 72 and 74.

There are outer covers 80 and inner covers 82 mounted on the side-frames 38 on both sides, and these outer covers 80 and inner covers 82 have roughly the same length as the side-frames 38. As is apparent from FIG. 5, the outer cover 80 has its base end linked to the side face of the side-frame 38 and extends vertically upward, and its upper end is bent horizontally and covers the traveling chain 28 and their attachments 68. On the other hand, the inner cover 82 extends vertically at the inner circumference of the attachments 68 of the traveling chain 28, and is supported by the flange 72 through an intervening bracket 84. The lower half portion of the inner cover 82 is inclined towards the inside of the bar screen conveyor 20.

Figure 7:
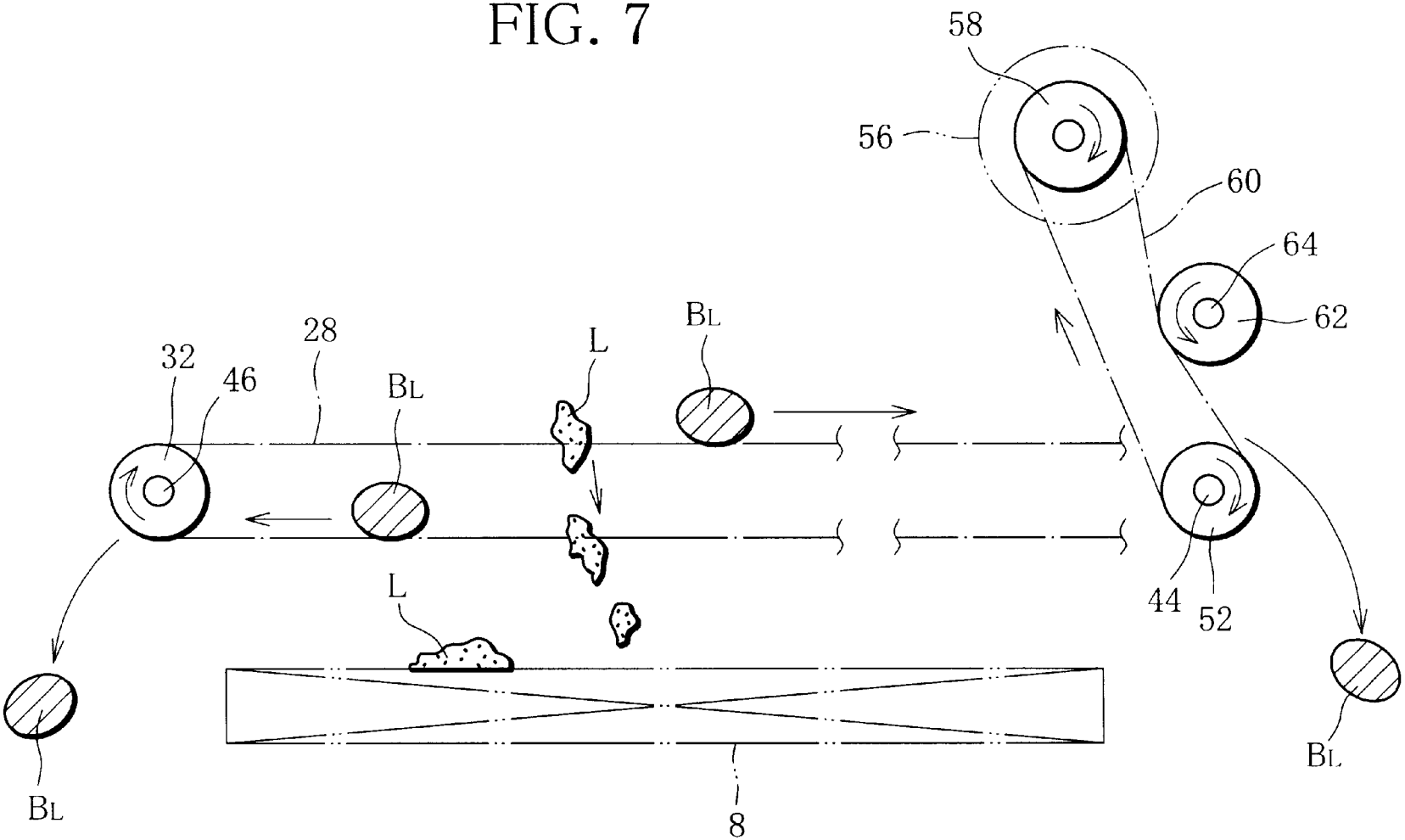
FIG. 7 is a simple drawing for describing the action of the bar screen conveyor.

When the output sprocket 58 is rotated by the electric motor 38 in the direction of the arrow in the drawing, this rotation is transferred to the sprocket axle 44 through the intervening driving chain 60, as shown in FIG. 7. This makes the sprockets 30 on both sides rotate simultaneously, and as a result, the traveling chains 28 on both sides run in synchronization in one direction, which is shown by an arrow in the drawing.

Such movement of the traveling chains 28 in the bar screen conveyor 20 moves the rows of bar-form-members 26, and runs their sieve-surface continuously in one direction, which is the traversing direction of the downstream conveyor 8. In this embodiment, the width W of the sieve-surface (refer to FIG. 2) of the bar screen conveyor 20 is configured to be approximately 300 mm, for example, and the running speed is configured to be approximately 20.5 m/min, for example.

When an eliminating airflow R is ejected from a row of air nozzles 13 inside the eliminating area S as shown in FIG. 1, the falling direction of the falling tobacco leaves L including the foreign substance B is deflected by this eliminating airflow R. At this moment, a relatively small foreign substance $B_S$ falls down with adjacent tobacco leaves L in the direction of the arrow in chain-line in the drawing. On the other hand, a relatively large foreign substance $B_L$ crosses the eliminating airflow R with inertia force, and falls in the direction of the arrow in broken line in the drawing.

It should be noted that the inventors of this invention have confirmed the following facts. That is, when the falling direction of a foreign substance is deflected by an eliminating airflow R, the degree of deflection changes depending on the ratio of the weight to the surface area of the foreign substance (=weight/surface area).

Figure 8:
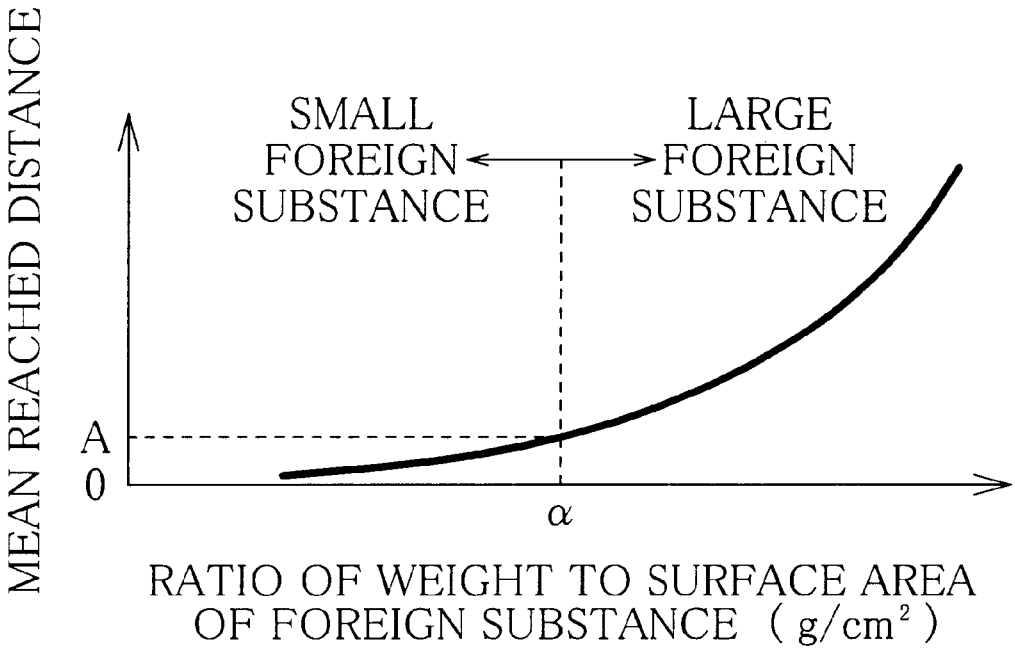
FIG. 8 is a graph showing the relation of the ratio of the weight to the surface area of the foreign substance, and the mean reached distance.

Referring now to FIG. 8, a relation between the ratio of the weight to the surface area of the foreign substance, and the mean reached distance of the foreign substance whose falling direction was actually deflected by an eliminating airflow R is shown. The mean reached distance of the foreign substance has a value acquired by the following method. First of all, a prescribed vertical drop below the terminus of the main conveyor 6 is taken, and this location is defined as the standard height. The difference in the installed height level between the main conveyor 6 and the downstream conveyor 8 can be used for this vertical drop value, for example. Next, when the foreign substance sent out from the terminus of the main conveyor 6 falls down to the above-mentioned standard height, the horizontal distance from the terminus of the main conveyor 6 is measured at that point. Such measurements are done several times for various foreign substances, and the mean reached distance is acquired by averaging these values.

As shown in FIG. 8, the mean reached distance of the foreign substance has a tendency to shorten as the ratio of the weight to the surface area of the foreign substance is lessened, and the degree of deflection by the eliminating airflow R increases accordingly. And the following can be understood from FIG. 8. That is, when a foreign substance, which has a ratio of the weight to the surface area equal to or smaller than a prescribed value a (approximately 0.5 to 0.6 for example), is defined as a relatively small foreign substance $B_S$, the mean reached distance of this foreign substance $B_S$ will be equal to or shorter than a prescribed value A (approximately 200 mm for example). Therefore, most of these small foreign substances $B_S$ will be sent to the foreign substance receiving box 16 directly, or through the intervening eliminating chute 18, and it is apparent that it is possible to remove the small foreign substances $B_S$ outside of the transfer path at this stage.

On the other hand, when a foreign substance, which has a ratio of the weight to the surface area of the foreign substance bigger than the above-mentioned prescribed value $\alpha$, is defined as a relatively large foreign substance $B_L$, the mean reached distance of this foreign substance $B_L$ will be longer than the prescribed value A. Therefore, it is difficult to eliminate these large foreign substances $B_L$, by sending them to the foreign substance receiving box 16 with the eliminating airflow R. Instead of this, most of the large foreign substances $B_L$ fall down onto the bar screen conveyor 20 when falling down towards the downstream conveyor 8, and are temporarily captured by the sieve-surface, as shown in FIG. 1.

After this, as shown in FIG. 7, the bar screen conveyor 20 transfers the captured foreign substance $B_L$ with the movement of the sieve-surface, and discharges it at its terminus. And the tobacco leaves L that dropped onto the sieve-surface together with the large foreign substance $B_L$, drops down through the opening between the bar-form-members 26, which are the sieve meshes, onto the downstream conveyor 8 at an appropriate timing.

Fall-off chutes 86 and 88 can be arranged and installed at both end portions of the bar screen conveyor 20, as shown in FIG. 3. The large foreign substance $B_L$ captured at the sieve-surface is guided to one of the fall-off chutes 86, and falls down into the foreign substance receiving box 22.

The bar screen conveyor 20 is constituted so that the sieve-surfaces compose pluralities of vertical layers that overlap each other, hence even when the captured foreign substance $B_L$ passes through the sieve-surface on the upper layer, the foreign substance $B_L$ is captured by the sieve-surface on the lower layer. The foreign substance $B_L$ captured by the sieve-surface at the lower layer is transferred by the movement of the traveling chain 28, which is shown by an arrow in the drawing, in the opposite direction of the movement of the sieve-surface at the upper layer, and is guided to the other fall-off chute 88, and falls into the foreign substance receiving box 22.

With the above-mentioned foreign substance eliminating apparatus, a large foreign substance $B_L$, which passes through the eliminating airflow R and is going to fall down onto the downstream conveyor 8 even after it has been detected and ejected by the eliminating airflow R, can be captured by the bar screen conveyor 20, and positively removed outside of the transfer path of the tobacco leaves L. To name but a few of these large foreign substances $B_L$ that are actually eliminated, there are gloves of production workers, or cord-like objects (cords for packaging or cut-off pieces of sheet-cords, and so on), for example.

Furthermore, it should be prevented that the tobacco leaves L are piled up on the bar screen conveyor 20, by running the sieve-surface of the bar screen conveyor 20 at all times.

As described in the above-mentioned best mode, the mixing of foreign substances into cigarette products can be prevented, and the quality of the manufactured cigarette products can be maintained at a high level, by applying the foreign substance eliminating apparatus to the raw-material processing stages of cigarettes. However, needless to say, this invention is not limited to cigarette products, and can be utilized to a broad range of applications, as a foreign substance eliminating apparatus to eliminate foreign substances from raw materials of other products.

Moreover, this invention is not limited to only the above-mentioned embodiment, and can be implemented in various modifications. For example, with respect to the bar screen conveyor 20, specific configurations such as detailed dimensions like the width of the sieve-surface W and the mounting pitch P of the bar-form-members 26, or the running speed can be changed according to the installing condition of the actual factory, as appropriate.

The number of bar screen conveyors 20 is not limited to only one, and plural conveyors can be installed in parallel. It is possible to have the transferring directions of the upstream main conveyor 6 and the downstream conveyor 8 cross each other.

What is claimed is:

1. A foreign substance eliminating apparatus comprising:

an upstream transfer path for transferring raw material;

a downstream transfer path located down below said upstream transfer path, for receiving and transferring the raw material falling down from being sent out of a terminus of said upstream transfer path;

detecting means for detecting a foreign substance from the raw materials being transferred on said upstream transfer path, and for outputting a detection signal;

deflecting means for deflecting the falling direction of the falling raw material and the foreign substance by ejecting an eliminating airflow towards the falling raw material, on reaching a decision of the existence of the foreign substance within the raw material, based on said detection signal;

capturing means for capturing the foreign substance passing through the eliminating airflow and falling down, above said downstream transfer path; and eliminating means for removing the foreign substance captured by said capturing means, to the outside of said downstream transfer path.

2. The foreign substance eliminating apparatus according to claim 1, wherein said capturing means includes a sieve-surface extending horizontally above the downstream transfer path, and covering the whole width of the downstream transfer path.

3. The foreign substance eliminating apparatus according to claim 1, wherein said capturing means includes a sieve-surface extending horizontally above the downstream transfer path, and covering the whole width of the downstream transfer path; and said eliminating means comprises a sieve conveyor having said sieve-surface travel in a traversing direction of said downstream transfer path.

4. The foreign substance eliminating apparatus according to claim 3, wherein said sieve conveyor comprises:

a pair of endless cables arranged on both sides of said sieve-surface, and traveling in synchronization in the same direction; and a plurality of bar-form-members bridged across said pair of endless cables, and arranged in parallel with a prescribed interval, to constitute said sieve-surface.

5. The foreign substance eliminating apparatus according to claim 3, wherein said sieve-surface is installed to form a plurality of vertical layers.

* * * * *